US010441014B1

(12) United States Patent
Chen

(10) Patent No.: US 10,441,014 B1
(45) Date of Patent: Oct. 15, 2019

(54) ARTIFICIAL TREE HAVING MULTIPLE TREE PORTIONS WITH ELECTRICAL CONNECTORS SECURED THEREIN

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 15/861,558

(22) Filed: Jan. 3, 2018

Related U.S. Application Data

(60) Provisional application No. 62/441,943, filed on Jan. 3, 2017.

(51) Int. Cl.
*A41G 1/00* (2006.01)
*A47G 33/06* (2006.01)
*A47G 33/08* (2006.01)

(52) U.S. Cl.
CPC ..... *A41G 1/005* (2013.01); *A41G 1/007* (2013.01); *A47G 33/06* (2013.01); *A47G 2033/0827* (2013.01)

(58) Field of Classification Search
CPC ..... A41G 1/005; F21W 2121/04; A47G 2033/0827
See application file for complete search history.

(56) References Cited

U.S. PATENT DOCUMENTS 735,010 A 7/1903 Zahl
1,656,148 A 1/1928 Harris
1,974,472 A 9/1934 Seghers
2,229,211 A 1/1941 Korengold
2,563,713 A 8/1951 Frei et al.
2,857,506 A 10/1958 Minteer
(Continued)

FOREIGN PATENT DOCUMENTS

CN 2102058 U 4/1992
CN 2242654 Y 12/1996
(Continued)

OTHER PUBLICATIONS

Petition for Inter Partes Review, Case IPR2014-01263, U.S. Pat. No. 8,454,186, dated Aug. 8, 2014 (66 pgs.).
(Continued)

*Primary Examiner* — Robert J May
(74) *Attorney, Agent, or Firm* — Christensen, Fonder, Dardi & Herbert PLLC

(57) ABSTRACT

An artificial tree including a first tree portion including a first trunk and first secured electrical connector. The first trunk comprises a first end, a main portion, and a second flared end defining second-end inside and outside diameters. The first connector is in the main portion and comprises a body with a diameter less than the second-end inside diameter for easy insertion through the second end and into the main portion. A second tree portion couples to the first, and includes a second trunk and a second secured electrical connector. The second trunk comprises a first end, an angled transition portion, a main portion, and a second end, the angled transition portion joining the first end and main portion. The second connector comprises a first portion aligned axially with a second portion, the second portion secured to the main portion, and the first portion inserted into the narrower first end.

20 Claims, 5 Drawing Sheets

(56) References Cited

U.S. PATENT DOCUMENTS 3,107,966 A 10/1963 Bonhomme
3,214,579 A * 10/1965 Pacini ..... H01R 25/006 362/123
3,234,073 A 2/1966 Raymond et al.
3,345,482 A 10/1967 Lou
3,398,260 A 8/1968 Martens
3,470,527 A 9/1969 Bonhomme
3,521,216 A 7/1970 Tolegian
3,585,564 A 6/1971 Skjervoll
3,603,780 A 9/1971 Lu
3,617,732 A 11/1971 Fisher
3,970,834 A 7/1976 Smith
3,985,924 A 10/1976 Pritza
4,020,201 A 4/1977 Miller
4,072,857 A 2/1978 DeVicaris
4,097,917 A 6/1978 McCaslin
4,140,823 A 2/1979 Weskamp
4,161,768 A 7/1979 Gauthier et al.
4,291,075 A 9/1981 Puleo
4,493,523 A 1/1985 Leong et al.
4,496,615 A 1/1985 Huang
4,516,193 A 5/1985 Murphy
4,675,575 A 6/1987 Smith et al.
4,759,729 A 7/1988 Kemppainen et al.
4,855,880 A 8/1989 Mancusi, Jr.
4,870,547 A 9/1989 Crucefix
4,890,000 A 12/1989 Chou
5,015,510 A 5/1991 Smith
5,071,362 A 12/1991 Martens et al.
5,091,834 A 2/1992 Kao et al.
5,149,282 A 9/1992 Donato et al.
5,409,403 A 4/1995 Falossi et al.
5,453,664 A 9/1995 Harris
5,624,283 A 4/1997 Hotea
5,653,616 A 8/1997 Hotea
5,695,279 A 12/1997 Sonnleitner et al.
5,758,545 A 6/1998 Fevre et al.
5,759,062 A 6/1998 Chen
5,775,933 A 7/1998 Chen
5,776,559 A 7/1998 Woolford
5,785,412 A 7/1998 Wu et al.
5,791,765 A 8/1998 Lin
5,791,940 A 8/1998 Chen et al.
5,839,819 A 11/1998 Pan
5,934,793 A 8/1999 Rahman
5,937,496 A 8/1999 Benoit et al.
6,056,427 A 5/2000 Kao
6,091,204 A 7/2000 Chen
6,347,965 B1 2/2002 Pan
6,354,719 B1 3/2002 Pan
6,514,581 B1 2/2003 Gregory
6,536,916 B1 3/2003 Rahman
6,575,595 B1 6/2003 Wu
6,595,657 B1 7/2003 Shieh
6,653,797 B2 11/2003 Puleo, Sr. et al.
6,672,750 B1 1/2004 Kao
6,733,167 B1 5/2004 Kao
6,794,825 B1 9/2004 Kao
6,883,951 B2 4/2005 Wu
6,908,215 B2 6/2005 Wu
6,914,194 B2 7/2005 Fan
6,951,405 B2 10/2005 Yao
7,021,598 B2 4/2006 Kao
7,029,145 B2 4/2006 Frederick
7,045,965 B2 5/2006 Li et al.
7,052,156 B2 5/2006 Primeau
7,055,980 B2 6/2006 Wu
7,055,981 B2 6/2006 Yao
7,066,739 B2 6/2006 McLeish
7,108,514 B2 9/2006 Chen et al.
7,132,139 B2 * 11/2006 Yang ..... A47G 33/06 428/17
7,235,815 B2 6/2007 Wang
7,264,392 B2 9/2007 Massabki et al.
7,326,091 B2 2/2008 Nania et al.
7,371,115 B1 5/2008 Hsieh et al.
7,445,824 B2 11/2008 Leung et al.
7,581,870 B2 9/2009 Massabki et al.
D608,685 S 1/2010 Krize
D609,602 S 2/2010 Krize
8,047,700 B2 11/2011 Massabki et al.
8,053,042 B1 * 11/2011 Loomis ..... A47G 33/06 362/123
8,298,633 B1 10/2012 Chen
8,454,186 B2 * 6/2013 Chen ..... F21V 21/002 362/123
8,454,187 B2 6/2013 Chen
8,469,734 B2 6/2013 Chen
8,469,750 B2 6/2013 Chen
D686,523 S 7/2013 Chen
8,562,175 B2 10/2013 Chen
8,568,015 B2 10/2013 Chen
D696,153 S 12/2013 Chen
8,608,342 B2 12/2013 Chen
8,870,404 B1 10/2014 Chen
8,876,321 B2 11/2014 Chen
8,916,242 B2 12/2014 Fu et al.
8,936,379 B1 1/2015 Chen
8,959,810 B1 2/2015 Leung et al.
8,974,072 B2 3/2015 Chen
9,044,056 B2 6/2015 Chen
9,055,777 B2 6/2015 Chen
9,066,617 B2 6/2015 Chen
9,119,495 B2 9/2015 Leung et al.
9,140,438 B2 9/2015 Chen
9,157,587 B2 10/2015 Chen
9,157,588 B2 10/2015 Chen
9,179,793 B2 11/2015 Chen
9,220,361 B1 12/2015 Chen
9,222,656 B2 12/2015 Chen
9,402,498 B2 8/2016 McRae
9,439,528 B2 9/2016 Chen
9,441,800 B1 9/2016 Chen
9,441,823 B1 9/2016 Chen
9,484,687 B1 11/2016 Chen
9,526,286 B2 12/2016 Chen
9,572,446 B2 2/2017 Chen
9,593,831 B2 3/2017 Yu
9,648,919 B2 5/2017 Chen
9,617,074 B2 6/2017 Chen
9,671,097 B2 6/2017 Chen
9,677,748 B1 6/2017 Chen
9,677,749 B2 6/2017 Chen
9,839,315 B2 12/2017 Leung et al.
9,861,147 B1 1/2018 Chen
9,883,566 B1 1/2018 Chen
9,883,706 B2 2/2018 Chen
10,044,139 B2 * 8/2018 Jalbert ..... H01R 13/15
2003/0198048 A1 10/2003 Frederick
2004/0004435 A1 1/2004 Hsu
2004/0012950 A1 1/2004 Pan
2004/0080281 A1 4/2004 Pan
2004/0090770 A1 5/2004 Primeau
2004/0096596 A1 5/2004 Palmer, III et al.
2004/0105270 A1 6/2004 Shieh
2004/0182597 A1 9/2004 Smith et al.
2005/0249892 A1 11/2005 Rocheleau
2006/0146578 A1 7/2006 Kuo
2006/0164834 A1 7/2006 Kao
2006/0274556 A1 12/2006 Massabki et al.
2007/0230174 A1 10/2007 Hicks et al.
2008/0107840 A1 5/2008 Leung et al.
2010/0159713 A1 6/2010 Nishihira et al.
2011/0062875 A1 3/2011 Altamura
2011/0256750 A1 10/2011 Chen
2012/0009360 A1 1/2012 Fu et al.
2012/0076967 A1 3/2012 Chen
2012/0098465 A1 4/2012 Rothschild
2013/0108808 A1 5/2013 Leung et al.
2013/0119893 A1 5/2013 Chen
2013/0120971 A1 5/2013 Chen
2013/0163231 A1 6/2013 Chen
2013/0301245 A1 11/2013 Chen
2013/0301247 A1 11/2013 Chen

(56) References Cited

U.S. PATENT DOCUMENTS

| | | | |
|---|---|---|---|
| 2013/0308301 | A1 | 11/2013 | Chen |
| 2014/0049168 | A1 | 2/2014 | Chen |
| 2014/0087094 | A1 | 3/2014 | Leung et al. |
| 2014/0215864 | A1 | 8/2014 | Fischer, Jr. et al. |
| 2014/0268689 | A1 | 9/2014 | Chen |
| 2014/0287618 | A1 | 9/2014 | Chen |
| 2014/0334134 | A1 | 11/2014 | Loomis |
| 2015/0029703 | A1 | 1/2015 | Chen |
| 2015/0070878 | A1 | 3/2015 | Yu |
| 2015/0072088 | A1 | 3/2015 | Fu |
| 2015/0157159 | A1 | 6/2015 | Leung et al. |
| 2015/0272250 | A1 | 10/2015 | Chen |
| 2016/0021957 | A1 | 1/2016 | Chen |
| 2016/0021958 | A1 | 1/2016 | Chen |
| 2016/0033097 | A1 | 2/2016 | Chen |

FOREIGN PATENT DOCUMENTS

| | | | |
|---|---|---|---|
| CN | 1181693 | | 5/1998 |
| CN | 2332290 | Y | 8/1999 |
| CN | 2484010 | Y | 4/2002 |
| CN | 1509670 | A | 7/2004 |
| CN | 2631782 | Y | 8/2004 |
| CN | 2751226 | Y | 1/2006 |
| CN | 100409504 | C | 9/2007 |
| CN | 100409506 | C | 8/2008 |
| CN | 201187701 | Y | 1/2009 |
| CN | 201829727 | U | 5/2011 |
| DE | 8436328 | | 4/1985 |
| DE | 10235081 | A1 | 2/2004 |
| FR | 1215214 | | 11/1959 |
| WO | WO 96/26661 | A1 | 9/1996 |

OTHER PUBLICATIONS

Petition for Inter Partes Review of U.S. Pat. No. 8,454,187, Case No. IPR2014-01264, filed Aug. 8, 2014 (63 pgs.).
Petition for Inter Partes ,Review, Case IPR2016-00800, U.S. Pat. No. 8,454,186, dated Apr. 18, 2016 (78 pgs.).
Petition for Inter Partes Review, Case IPR2016-00802, U.S. Pat. No. 9,044,056, dated Apr. 28, 2016 (73 pgs.).
Petition for Inter Partes Review, Case IPR2016-01611, U.S. Pat. No. 8,454,187, dated Aug. 26, 2016 (91 pgs.).
Petition for Inter Partes Review, Case IPR2016-01612, U.S. Pat. No. 8,454,187, dated Aug. 26, 2016 (93 pgs.).
Petition for Inter Partes Review, Case IPR2016-01613, U.S. Pat. No. 9,044,056, dated Sep. 1, 2016 (91 pgs.).
Petition for Inter Partes Review, Case IPR2016-01609, U.S. Pat. No. 8,454,186, dated Sep. 2, 2016 (99 pgs.).
Petition for Inter Partes Review, Case IPR2016-01610, U.S. Pat. No. 8,454,186, dated Sep. 2, 2016 (86 pgs.).
Petition for Inter Partes Review, Case IPR2016-01615, U.S. Pat. No. 8,936,379, dated Sep. 2, 2016 (90 pgs.).
Petition for Inter Partes Review, Case IPR2016-01617, U.S. Pat. No. 8,936,379, dated Sep. 2, 2016 (63 pgs.).
Petition for Inter Partes Review, Case IPR2016-01616, U.S. Pat. No. 8,936,379, dated Sep. 13, 2016 (89 pgs.).
Final Written Decision, Cases IPR2016-01610 (U.S. Pat. No. 8,454,186) and IPR2016-01612 (U.S. Pat. No. 8,454,187), dated Feb. 26, 2018 (82 pgs.).
Final Written Decision, Cases IPR2016-01615, IPR2016-01616, and IPR2016-01617 (U.S. Pat. No. 8,936,379), dated Feb. 26, 2018 (77 pgs.).
Final Written Decision, Case IPR2016-01613 (U.S. Pat. No. 9,044,056), dated Feb. 26, 2018 (43 pgs.).
Final Written Decision, Cases IPR 2016-01781, IPR2016-01782 (U.S. Pat. No. 8,974,072), dated May 7, 2018 (37 pgs.).

* cited by examiner

ARTIFICIAL TREE HAVING MULTIPLE TREE PORTIONS WITH ELECTRICAL CONNECTORS SECURED THEREIN

RELATED APPLICATIONS

This application claims the benefit of U.S. Provisional Patent Application No. 62/441,943, filed Jan. 3, 2017, the disclosure of which is incorporated by reference herein in its entirety.

FIELD OF THE INVENTION

The present invention is generally directed to lighted artificial trees. More specifically, the present invention is directed to trunk connector systems for lighted artificial trees and artificial trees with trunk connector systems.

BACKGROUND OF THE INVENTION

Lighted artificial trees often are manufactured to include several tree portions that fit together by joining hollow, metal trunk sections. Some such multi-sectional, lighted artificial trees may include electrical power systems located within the interior portions of the trunk of the tree. These electrical power systems may include one or more electrical connectors at the ends of the trunk sections. Joining the trunk sections together causes an electrical connector at the end of one trunk section to connect to another electrical connector at the end of another trunk section. This causes an electrical connection to be made between the two trunk sections, and two tree sections, for providing power from one tree section to another tree section.

For these types of trunk-powered, lighted artificial trees, challenges remain with respect to securing electrical connectors within their respective trunk sections as connectors can move with repeated or forceful use. Making secure and safe mechanical and electrical connections between tree and trunk sections remains a challenge within the field of known artificial trees.

SUMMARY OF THE INVENTION

Embodiments of the disclosure include artificial trees, as well as secured connection systems and connectors for artificial trees.

In an embodiment, an artificial tree comprises a first tree portion including a first trunk portion, and a first trunk electrical connector, wherein the first trunk portion comprises a first end, a main portion, and a second end, the main portion defines a main outside diameter and a main inside diameter, and the second end includes a flared portion defining a second-end outside diameter and a second-end inside diameter, the second-end outside diameter being greater than the main outside diameter, the first trunk portion defining a first trunk axis extending between the first end and the second end, and wherein the first electrical connector is inserted into the main portion of the first trunk portion and comprises a body portion having an outside diameter that is less than the second-end inside diameter for easy insertion through the second end of the first trunk portion and into the main portion. The artificial tree also comprises a second tree portion configured to couple to the first tree portion, the second tree portion having a second trunk portion and a second trunk electrical connector, wherein the second trunk portion comprises a first end, an angled transition portion, a main portion, and a second end, the first end defining a first-end outside diameter that is larger than an outside diameter of the main portion, the angled transition portion joining the first end and the main portion, the second trunk portion defining a second trunk axis extending between the first end and the second end, and wherein the second trunk electrical connector comprises a first portion aligned axially with a second portion, the second portion of the second connector inserted into, and secured to, the main portion of the second trunk portion, and the first portion of the second connector inserted into the first end of the second trunk portion.

In another embodiment, an artificial tree comprises a base portion; a first tree portion including a first trunk portion insertable into the base portion, a first trunk electrical connector inserted into the first trunk portion, a first plurality of branches, and a first light string on the first plurality of branches; a second tree portion configured to couple to the first tree portion, the second tree portion including a second trunk portion, a second trunk electrical connector inserted into the second trunk portion, a second plurality of branches, and second light string on the second plurality of branches. Further, the second trunk portion comprises a first end, an angled transition portion, a main portion, and a second end, the first end defining a first-end outside diameter that is larger than an outside diameter of the main portion, the angled transition portion joining the first end and the main portion, the second trunk portion defining a trunk axis extending between the first end and the second end, and even further, the second trunk electrical connector comprises a first portion aligned axially with a second portion, the second portion of the second connector inserted into, and secured to, the main portion of the second trunk portion, and the first portion of the second connector extending within the first end of the second trunk portion without contacting an inside surface of the first end of the second trunk portion, such that a circumferential gap is formed between an outside surface of the first portion of the second trunk electrical connector and the inside surface of the second end of the second trunk portion.

BRIEF DESCRIPTION OF THE FIGURES

The invention can be understood in consideration of the following detailed description of various embodiments of the invention in connection with the accompanying drawings, in which:

FIGS. 2-3 depict an embodiment of a first or lower tree portion of the tree of FIG. 1, with an embodiment of a portion of a trunk connection system for a lighted artificial tree, whereas FIG. 2 depicts a connector prior to assembly into a trunk and FIG. 3 depicts a trunk portion for receiving the connector;

FIGS. 4-7 depict an embodiment of a second or middle tree portion of the tree of FIG. 1, with an embodiment of a portion of a trunk connection system for a lighted artificial tree, whereas FIG. 4 depicts a trunk portion, FIG. 5 depicts a trunk portion and an upper connector, FIG. 6 depicts a trunk portion and a lower connector, and FIG. 7 depicts the trunk portion in cutaway depicting the upper and lower connectors in the trunk interior; and FIGS. 8-12 depict an embodiment of a third or top tree portion of the tree of FIG. 1, with an embodiment of a portion of a trunk connection system for a lighted artificial tree, whereas FIG. 8 depicts an assembled third tree portion, FIG. 9 depicts a partially-assembled third tree portion, FIG.

10 depicts a partially-exploded view of the third tree portion, and FIG. 11 depicts another partially exploded view of the third tree portion.

Figure 1:
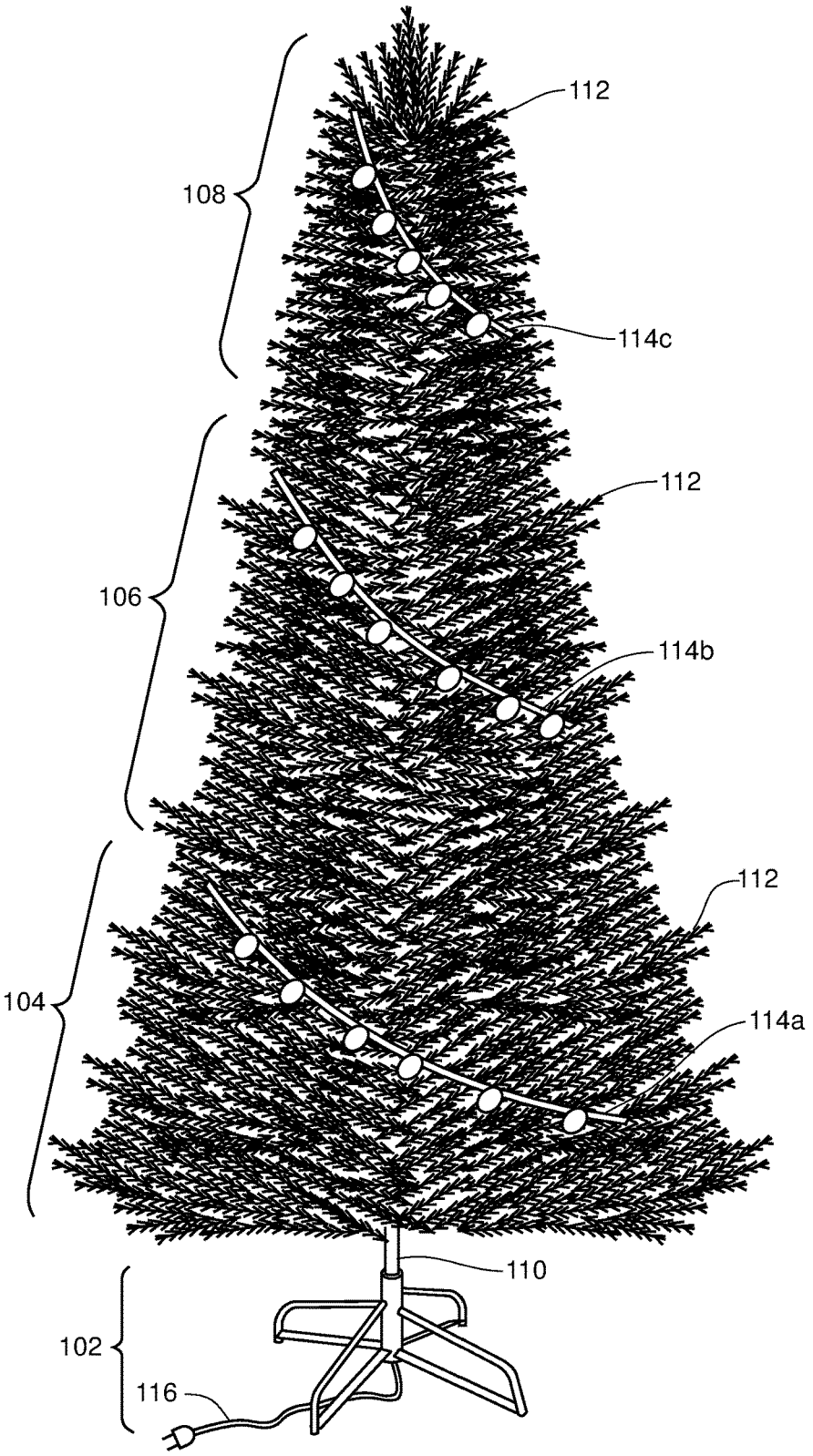
FIG. 1 is an embodiment of a lighted artificial tree, according to an embodiment.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIG. 1, a lighted artificial tree 100, according to an embodiment of the present invention, is depicted. In an embodiment, lighted artificial tree 100 includes base 102, first tree portion 104, second tree portion 106, and third tree portion 108. As depicted, first tree portion 104 is a lower tree portion, second tree portion 106 is a middle tree portion, and third tree portion 108 is an upper or top tree portion. However, it will be understood that tree 100 may include one, two, three or more tree portions, not necessarily three tree portions. Further, reference to a "first", "second" and "third" tree portions is not limiting to lower, middle and upper tree portions, such that a first tree portion may be a middle tree portion, and an second tree portion may be an upper tree portion, and so on.

In an embodiment, tree 100 also includes trunk 110, which may comprise multiple trunk sections or trunk portions as described further below with respect to the figures, multiple branches 112, and multiple light strings 114, distributed about the branches 112, and power cord 116. Each light string 114 includes a plurality of insulated conductors and lighting elements, such as incandescent lamps and/or light-emitting diodes (LEDs).

Figure 2:
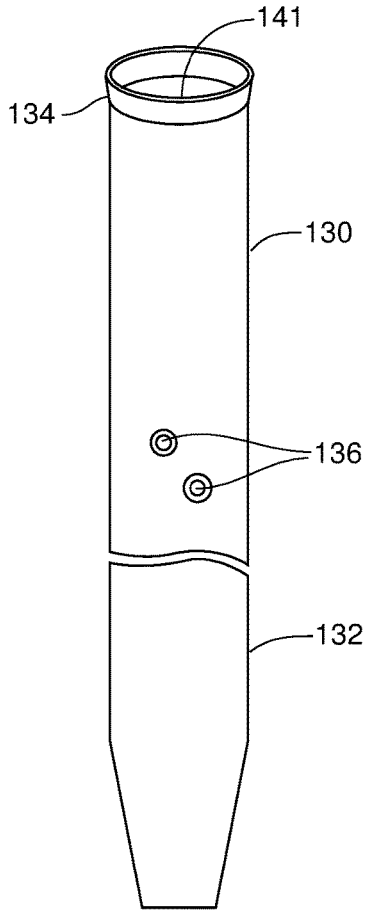
Figure 3:
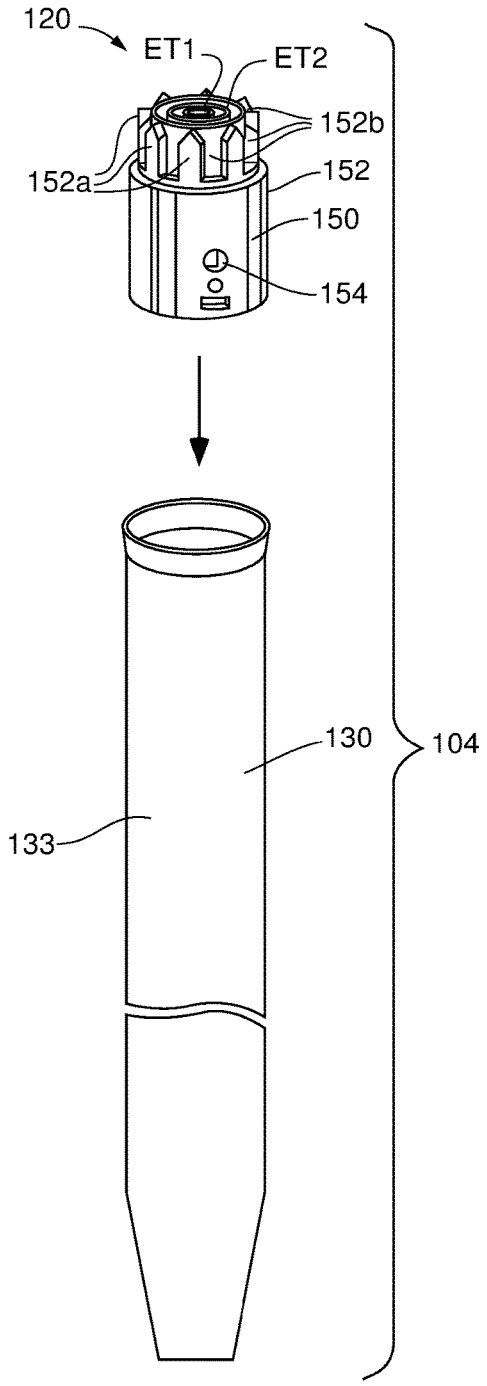
Figure 4:
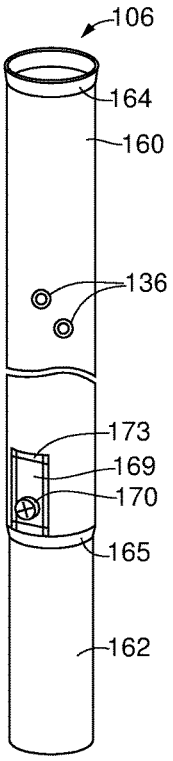
Figure 5:
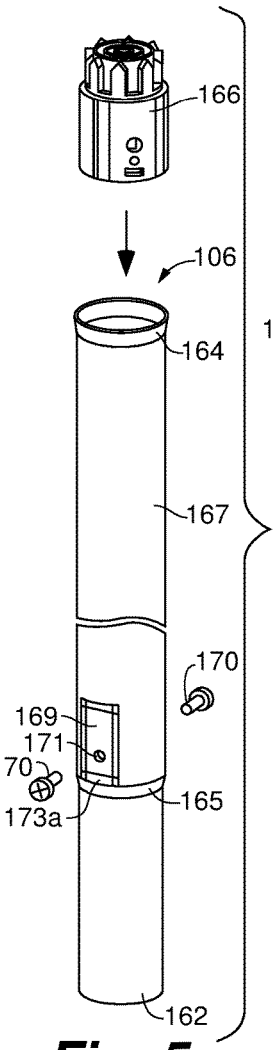

Referring to FIGS. 2-3, first or bottom tree portion 104 of tree portion 100 is depicted with branches and light strings removed. Bottom portion 104 includes trunk portion 130 and an embodiment of a trunk-electrical connector 150. Embodiments and features of trunk electrical connector 150 are as described herein, but additional features and embodiments are described in U.S. Pat. No. 9,179,793, entitled MODULAR TREE WITH ROTATION-LOCK ELECTRICAL CONNECTORS, issued Nov. 10, 2015, US Pat. Pub. No. 2014/0268689 A1, entitled MODULAR TREE WITH TRUNK CONNECTORS, published Sep. 18, 2014, and US 2013/0308301 A1, entitled MODULAR TREE WITH LOCKING TRUNK AND LOCKING ELECTRICAL CONNECTORS, published Nov. 21, 2013, all of which are incorporated herein by reference.

In an embodiment, trunk portion 130 defines inside cavity 131, and includes a first end 132 and a second end 134, and a middle or main portion 133 extending between first end 132 and second end 134. In an embodiment, main portion 133 defines a constant outside diameter. In an embodiment, first end 132 may be tapered so as to fit into base 102. In an embodiment, second end 134 may be flared or "bell-mouthed" for ease of insertion of connector 150 (and as described further below, for insertion of an end of a trunk of second tree portion 106), connector 150, in an embodiment, having an outer diameter similar to, the same as, or slightly larger than an inside diameter of trunk 130, and for easier insertion of an end of another trunk section, as described further below.

In an embodiment trunk portion 130 comprises a hollow, metal material, as would be understood by one of ordinary skill in the art. In other embodiments, trunk portion 130 comprises other materials, such as polymers or other generally rigid materials.

Trunk portion 130, in an embodiment, also defines one or more concave portions 136, which in an embodiment project radially inward. In an embodiment, concave portions 136 may be formed after insertion of electrical connector 150 into trunk 130, as described further below.

In an embodiment, trunk electrical connector 150 includes an insulative or generally non-conductive body portion 152 and two, three, four, or more conductive electrical terminals ET, such as ET1 and ET2, exposed at an open top end of conductor 150. Body portion 152, in an embodiment, may define one or more concave portions 154 for receiving concave portions 136 of trunk portion 130.

Figure 6:
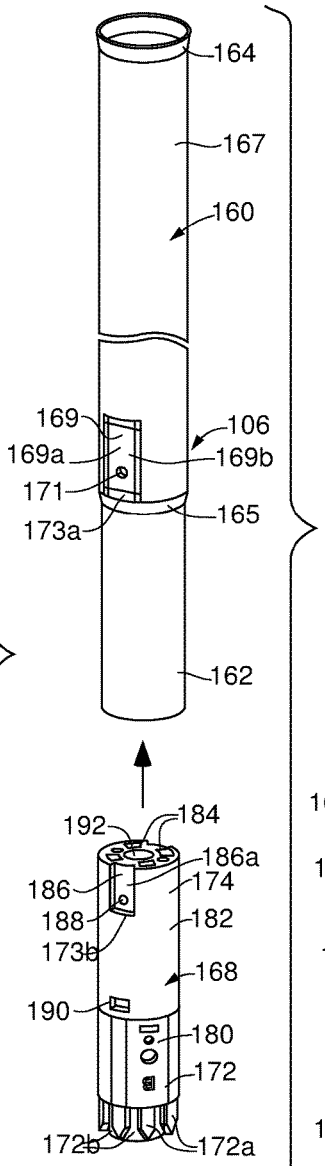

As depicted, body portion 152 may also include rotation-locking structure comprising, for example, projections 152*a* and recesses 152*b*, which are configured to receive corresponding rotation locking structure 172*b* and 172*a* from another trunk electrical connector, such as trunk electrical connector 166, when tree portions 104 and 106, and their corresponding trunk electrical connectors, are joined, as described further below with respect to FIGS. 6 and 7.

In an embodiment, when assembling trunk electrical connector 150 into trunk portion 130, trunk electrical connector 150 is inserted into trunk 130 axially to a predetermined positioned, and rotationally aligned (before or after insertion) to a predetermined rotation alignment with trunk 130. In an embodiment, after insertion, trunk portion 130 is pushed or punched to form concave portions 136, which are received into concave portions 154 of electrical connector 150, thereby axially and rotationally securing electrical connector 150 within first trunk portion 130.

In other alternative embodiments, instead of concave portions, fasteners, such as screws, bolts, rivets and so on may be used to secure electrical connector 150 axially and rotationally within first trunk portion 130.

In an embodiment, once finally positioned and secured, trunk electrical connector 150 is located fully within trunk portion 130 at a predetermined depth, or lengthwise distance from end 134 of first trunk portion 130.

Trunk electrical connector 150 and trunk portion 130 form a portion of an embodiment of a trunk connection system 120 of lighted artificial tree 100 that in an embodiment, comprises multiple connectors 150, 166, 168 and 204 that are in electrical connection with each other when tree 100 is assembled.

Referring to FIGS. 4-7, second, or middle tree portion 106 is depicted without branches or light strings.

In an embodiment, middle tree portion 106 includes second trunk portion 160 with first end 162 and second end 164, first trunk electrical connector 166, second trunk electrical connector 168, wires W, which electrically connect connectors 166 and 168 and their respective terminals, and fasteners 170.

In an embodiment, first trunk end 162 is narrower than other portions of second trunk portion 160, including second trunk end 164. In an embodiment, first trunk end 162 has an outer diameter that is slightly smaller than, or substantially the same as, an inside diameter of second end 134 of first trunk portion 130, such that first end 162 can fit into second end 134.

Trunk portion 160 may also include transition or angled portion 165 that is the portion between the larger and smaller diameter portions of trunk 160. In an embodiment, angle portion 165 abuts bell-mouthed or flared portion 134 when first end 162 is fit into second end 134.

In an embodiment, a middle or main portion 167 of trunk portion 160, including most of second end 164, except for its flared portion, defines a diameter that is larger than that of first end 162.

In an embodiment, trunk electrical connector 166 is substantially the same as trunk electrical connector 152, and is inserted and secured in substantially the same manner as described above with respect to connector 152 and trunk portion 130.

In an embodiment, and as depicted, trunk portion 160 may also include channel 169, which projects radially inward as radially-inward projection 169*a*, the radially-inward projection 169*a* being configured to be received by channel 186 of connector 168 as described further below. Trunk portion 160 may also define one or more holes 171 in channels 169 for receiving fasteners 170. In an embodiment, channels 169 may define planar surfaces 169*b*, which define holes 171. By being substantially planar, rather than curved, planar surfaces 169*b* are easier to drill through to form holes 171, thereby providing a manufacturing advantage.

In an embodiment, and as depicted, trunk electrical connector 168 includes first portion 172 and second portion 174. In an embodiment, portions 172 and 174 are integral to one another, rather than separate parts or portions. In another embodiment, portions 172 and 174 are separate portions or pieces assembled together.

Figure 12:
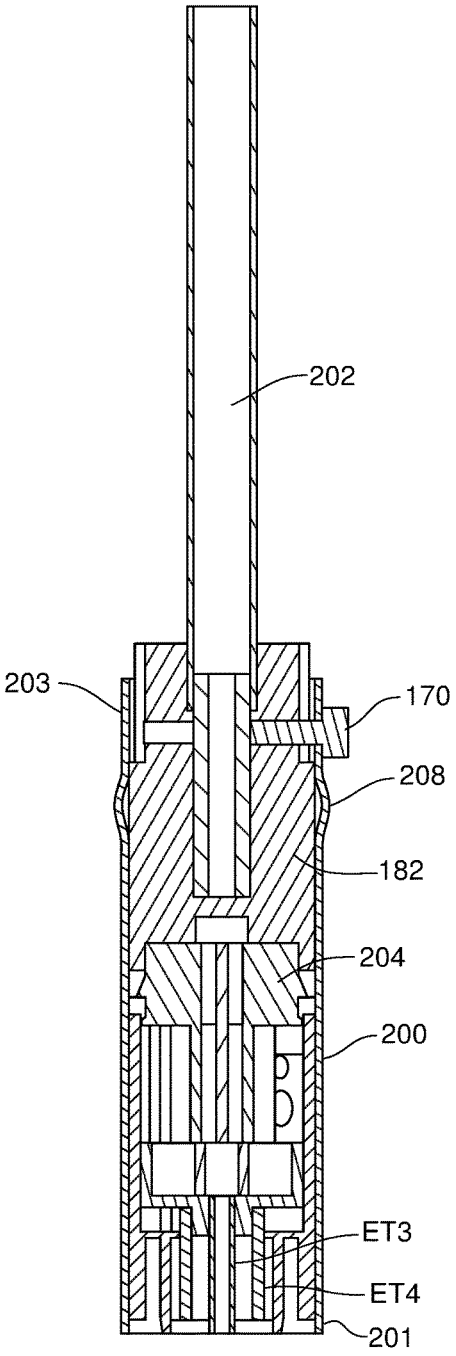

In an embodiment, first portion 172 includes first body portion 180 and two to four or more electrical terminals, such as ET3 and ET4 (see ET3 and ET4 depicted in FIG. 12).

In an embodiment, second portion 174 includes second body portion 182, which may be integral to first body portion 180, such as by molding or casting of a polymer. In an embodiment, second body portion 174 defines a plurality of cavities 184. In an embodiment, cavities 184 are configured to receive wires, such as wires W extending from connector 166 to connector 168 and one or more channels or connector channels 186, which may include holes 188. In an embodiment, channel 186 forms a substantially planar surface 186*a*. Second body portion 182 may also include one or more openings 190 that may include locating tabs. Second body portion 174 may also define opening 192 configured to receive a portion of an upper trunk portion, as described further below.

As depicted, during assembly, trunk electrical connector 168 is inserted into trunk portion 160, at first end 162. Trunk connector 168 is inserted axially, then channel 186 receives channel projection 169*a* formed by channel 169. Stop or edge portion 173*a* at channel 169 may abut a portion of second body portion 174, such as stop portion 173*b*. The channel to channel coupling limits axial and rotational movement of connector 168 in trunk portion 160. Fasteners 170 may then be inserted through holes 171 in trunk portion 160 and into holes 188 of second body portion 182.

Figure 7:
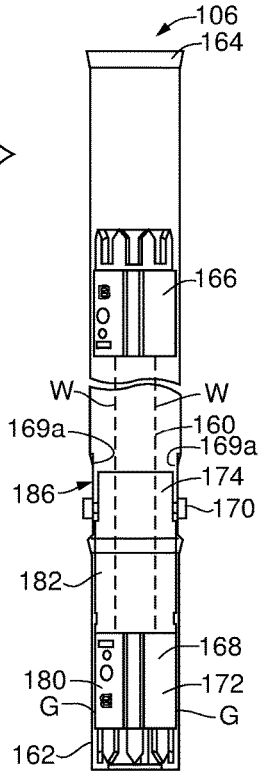
Figure 8:
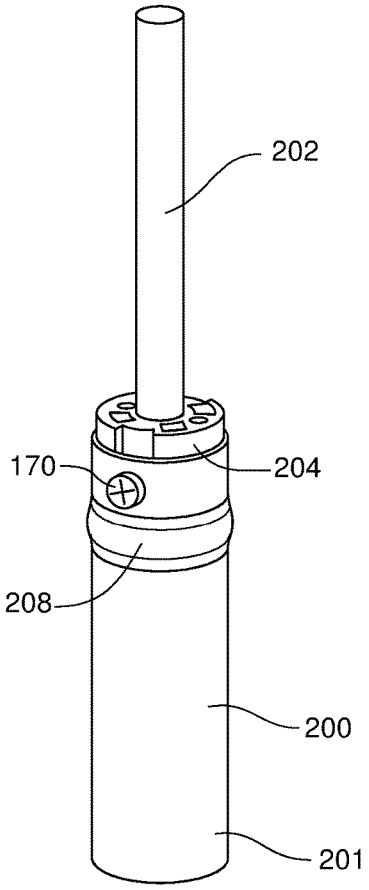
Figure 9:
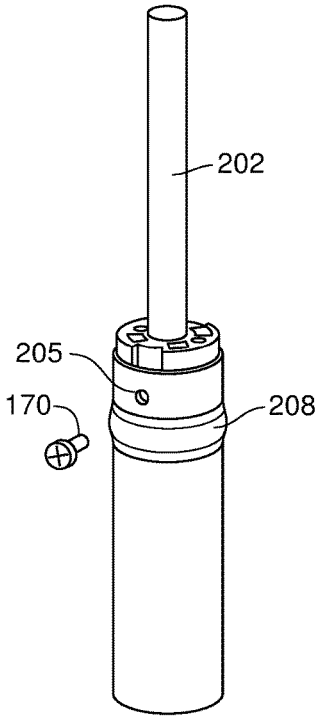
Figure 10:
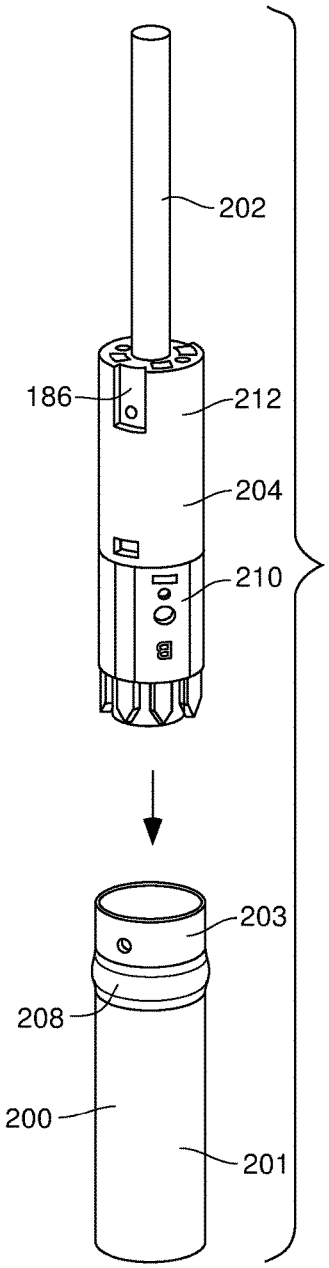
Figure 11:
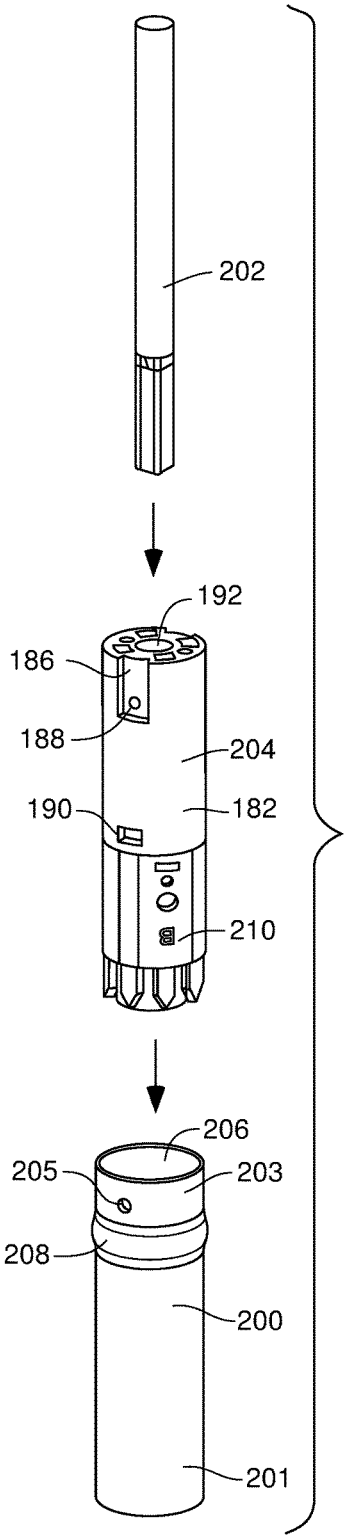

Referring specifically to FIG. 7, a cross section of trunk portion 160 with connector 166 in second end 164, and connector 168 in first end 162 is depicted.

As depicted, second portion 174 with its second body portion 182 is received into a middle portion of trunk 160, while first portion 172 is received in first end 162 of trunk portion 160. In this manner, first portion 172, which includes the electrical terminals for connecting to ET1 and ET2, and portions to connect to other connectors, such as projections 172*a* and recesses 172*b*, is not mechanically attached to narrow end 162 of trunk portion 160, other than by a snug fit or compression fit. In an embodiment, and as depicted, first portion 172 does not contact an inside surface of first end 162 of trunk portion 160, such that a circumferential gap G is formed between an outside surface of first portion 172 and an inside surface of narrow, second end 162 of second trunk portion 160. On the other hand second portion 174, is subjected to mechanical forces due to the joining of connector 168 to trunk portion 160.

Consequently, connector 168 is less likely to be broken or damaged during the assembly process. Further, a superior mechanical connection between connector 168 and trunk portion 160 may be made.

When second tree portion 106 is coupled to first tree portion 104, connector 168 couples to connector 150, such that the electrical terminals of the respective connectors make an electrical connection, thereby making an electrical connection between tree portion 104 and tree portion 106. Further, in the embodiment depicted, when anti-rotation structure is present, projections 172*a* are received by recesses 152*b*, and projections 152*a* are received by recesses 172*b*, thereby also mechanically joining connectors 150 and 168 in an interlocking manner such that the two connectors cannot, or substantially cannot, rotate relative to one another about an axis defined by trunk portion 106 or trunk 110.

Referring to FIGS. 8-12, an embodiment of top or third tree portion 108 is depicted.

In an embodiment, third or top portion 108 includes lower trunk portion 200 and upper trunk portion 202, as well as connector 204.

In an embodiment, lower trunk portion 200 is a generally short, hollow trunk portion that may comprise a metal material. In an embodiment, lower trunk portion 200 defines an interior cavity 206, and includes a bulged or flared portion or circumferential ring 208. In an embodiment, flared portion 208 comprises an outwardly projection portion of an upper end of lower trunk portion 200. In an embodiment, portion 208 is integral to, or formed by a deformation of trunk portion 200, but in other embodiments, may comprise a separate part or piece, such as a ring assembled onto trunk portion 200.

In an embodiment, trunk portion 200 is configured to be inserted into second trunk end 164 of second trunk portion 160, forming a snug, friction or other fit. In an embodiment, lower trunk portion 200 has an outside diameter that is similar to the outside diameter of end 162 of trunk portion 164. Flared portion 208 is configured to serve as a mechanical stop to limit axial movement of trunk portion 200 inserted into trunk portion 160, such that portion 208 abuts flared or bell-mouthed end 164 of trunk section 160. In an embodiment, flared portion 208 may comprise a ring inserted over end 206; in another embodiment, flared portion 208 comprises a portion of trunk portion 200 that is deformed to bulge outwardly.

Unlike other known upper or tree portions, in an embodiment, when assembled, only a portion of bottom portion 200 projects above and outside trunk portion 160. As such, in an embodiment, branches may not be attached to bottom portion 200, but only to top trunk portion 202. Doing so can create a more pleasing aesthetic look because branches in the top section all attach to the same diameter trunk section in the same manner, allowing for a more uniform pyramidal shape as branches are gradually shortened from a lower to an upper end.

In an embodiment, connector 204 is the same as, or substantially the same as connector 168.

In assembly, connector 204 is inserted into trunk portion 200. First portion 210 is received into trunk portion 200 at a lower end 201 and second portion 212 is received at upper end 203. Channels 186 may or may not receive corresponding channels and projections of trunk portion 200. Fasteners 170 are inserted through holes 205 in trunk portion 200 and into second connector portion 212.

Upper trunk portion 202 is received by hole 192 securing it to connector 204.

When tree portion 108 is coupled to tree portion 106, connector 204 coupled to, and in electrical connection with, connector 166, thereby electrically connecting connector 204 to connectors 166, 168 and 150, and electrically connecting tree portions 104, 106 and 108.

The various embodiments of tree trunk keying systems as described and depicted above provide a number of features to enhance the assembly, safety, and operation of modern, multi-sectional artificial trees, including modular lighted trees of the claimed invention.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. An artificial tree, comprising:

a first tree portion including a first trunk portion, and a first trunk electrical connector, wherein the first trunk portion comprises a first end, a main portion, and a second end, the main portion defines a main outside diameter and a main inside diameter, the first trunk portion defining a first trunk axis extending between the first end and the second end, and wherein the first trunk electrical connector is inserted into the main portion of the first trunk portion closer to the second end than the first end and comprises a body portion; and a second tree portion configured to couple to the first tree portion, the second tree portion having a second trunk portion and a second trunk electrical connector, wherein the second trunk portion comprises a first end, an angled transition portion, a narrow portion extending between the first end and the angled transition portion, a main portion, and a second end, the narrow portion defining an outside diameter that is smaller than an outside diameter of the main portion, the angled transition portion joining the narrow portion and the main portion, the second trunk portion defining a second trunk axis extending between the first end and the second end, and wherein the second trunk electrical connector comprises a first portion aligned axially with a second portion, the second portion of the second trunk electrical connector inserted into, and secured to, the main portion of the second trunk portion, and the first portion of the second connector inserted into the narrow portion of the second trunk portion, such that the second trunk electrical connector extends axially from the narrow portion through the angled transition portion of the second trunk portion and into the main portion of the second trunk portion.

2. The artificial tree of claim 1, wherein the main portion of the second trunk portion defines a channel forming a radially-inward projecting portion, and the second portion of the second trunk electrical connector defines a connector channel receiving the radially-inward projecting portion for rotationally aligning the second trunk electrical connector within the second trunk portion and for limiting rotation of the second trunk electrical connector within the second trunk portion.

3. The artificial tree of claim 2, wherein the main portion of the second trunk portion defines a through-hole, and the second portion of the second trunk electrical connector defines a hole aligned with the through-hole, and a fastener is inserted through the through-hole and into the hole of the second portion of the second trunk electrical connector.

4. The artificial tree of claim 3, wherein the first body of the first trunk electrical connector defines a recess, and the main portion of the first trunk portion defines a concave portion that is aligned with the recess, such that a portion of the main portion extends into the recess for holding the first trunk electrical connector in an interior of the main portion of the first trunk body.

5. The artificial tree of claim 1, wherein the first portion of the second trunk electrical connector extends within the narrow portion of the second trunk portion without contacting the second end of the second trunk portion.

6. The artificial tree of claim 1, wherein the body portion of the first trunk electrical connector defines a first axial length and the first portion and the second portion of the second trunk electrical connector together define a combined axial length that is greater than a first axial length of the body portion of the first connector.

7. The artificial tree of claim 1, wherein the first trunk electrical connector includes first rotation-locking structure including first projections and first recesses, the first portion of the second trunk electrical connector includes second rotation-locking structure including second projections and second recesses, the first projections configured to fit into the second recesses, and the second projections configured to fit into the first recesses, so as to limit rotation of the first trunk electrical connector relative to the second trunk electrical connector.

8. The artificial tree of claim 1, wherein the second tree portion further comprises a third trunk electrical connector inserted into the main portion of the second trunk portion and adjacent the second end of the second trunk portion.

9. The artificial tree of claim 8, wherein the second tree portion further includes wires electrically connecting the second trunk electrical connector and the third trunk electrical connector.

10. The artificial tree of claim 9, further comprising branches coupled to the first trunk portion and a light string on the first branches.

11. The artificial tree of claim 1, further comprising a third tree portion configured to couple to the second tree portion, the third tree portion including a third trunk portion including a circumferential ring defining an outside surface, wherein the second end of the second trunk portion comprises a flared portion defining an inner surface, and the outside surface of the circumferential ring is configured to abut the inside surface of the flared portion when the third tree portion is coupled to the second tree portion.

12. The artificial tree of claim 11, wherein the third tree portion includes a fourth trunk electrical connector configured to couple to the third trunk electrical connector.

13. The artificial tree of claim 12, wherein the third trunk portion includes a lower portion and an upper portion, the upper portion inserted into a hole defined by the fourth trunk electrical connector.

14. The artificial tree of claim 1, wherein the second end of the first trunk portion includes a flared portion defining a second-end outside diameter, the second-end outside diameter being greater than an outside diameter of the main portion of the first trunk portion.

15. An artificial tree, comprising:

a base portion;

a first tree portion including a first trunk portion insertable into the base portion, a first trunk electrical connector inserted into the first trunk portion, a first plurality of branches, and a first light string on the first plurality of branches;

a second tree portion configured to couple to the first tree portion, the second tree portion including a second trunk portion, a second trunk electrical connector inserted into the second trunk portion, a second plurality of branches, and a second light string on the second plurality of branches, wherein the second trunk portion comprises a first end, an angled transition portion, a narrow portion extending between the first end and the angled transition portion, and a second end, the narrow portion defining an outside diameter that is smaller than an outside diameter of the main portion, the angled transition portion joining the narrow portion and the main portion, the second trunk portion defining a trunk axis extending between the first end and the second end, and wherein the second trunk electrical connector comprises a first portion aligned axially with a second portion, the second portion of the second connector inserted into, and secured to, the main portion of the second trunk portion, and the first portion of the second connector extending into the narrow portion without contacting any portion of an inside surface of the narrow portion of the second trunk portion, such that a circumferential gap is formed between an outside surface of the first portion of the second trunk electrical connector and the inside surface of the narrow portion of the second trunk portion.

16. The artificial tree of claim 15, wherein the main portion of the second trunk portion forms a radially-inward projecting portion, and the second portion of the second trunk electrical connector defines a channel receiving the radially-inward projecting portion for rotationally aligning the second trunk electrical connector within the second trunk portion and for limiting rotation of the second trunk electrical connector within the second trunk portion.

17. The artificial tree of claim 15, wherein a fastener extends through a through hole defined by the main portion of the second trunk portion and into the second portion of the second trunk electrical connector for securing the second trunk electrical connector to the second trunk portion, and a concave portion of the first trunk portion is received by a recess in the first trunk connector for securing the first trunk electrical connector to the first trunk portion.

18. The artificial tree of claim 15, further comprising a third tree portion configured to couple to the second tree portion, the third tree portion including a third trunk portion including a circumferential ring defining an outside surface, wherein the outside surface of the circumferential ring is configured to abut an inside surface of the end portion of the second trunk portion when the third tree portion is coupled to the second tree portion.

19. The artificial tree of claim 18, wherein the third trunk portion includes a lower trunk portion and an upper trunk portion, the upper trunk portion inserted into a hole defined by a third trunk electrical connector in the lower trunk portion.

20. The artificial tree of claim 15, wherein the first and second trunk portions comprise a metal material, and the first and second trunk electrical connectors comprise a polymer material.

* * * * *